US008157550B2

(12) United States Patent
Kudo

(10) Patent No.: US 8,157,550 B2
(45) Date of Patent: Apr. 17, 2012

(54) SCROLL COMPRESSOR HAVING SPIRAL BODIES WITH SEAL PROJECTIONS

(75) Inventor: Takayuki Kudo, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 352 days.

(21) Appl. No.: 12/445,540

(22) PCT Filed: Oct. 16, 2007

(86) PCT No.: PCT/JP2007/070147

§ 371 (c)(1),
(2), (4) Date: Apr. 14, 2009

(87) PCT Pub. No.: WO2008/047781

PCT Pub. Date: Apr. 24, 2008

(65) Prior Publication Data

US 2010/0086427 A1 Apr. 8, 2010

(30) Foreign Application Priority Data

Oct. 18, 2006 (JP) ..... 2006-283698

(51) Int. Cl.
*F03C 2/00* (2006.01)
*F03C 4/00* (2006.01)
*F04C 18/00* (2006.01)

(52) U.S. Cl. ..... 418/55.4; 418/55.2; 418/142

(58) Field of Classification Search ..... 418/55.1–55.6, 418/57, 104, 142
See application file for complete search history.

(56) References Cited

U.S. PATENT DOCUMENTS 4,627,799 A * 12/1986 Terauchi ..... 418/55.4
4,701,115 A * 10/1987 Shimizu et al. ..... 418/55.4
5,807,088 A * 9/1998 Fukanuma et al. ..... 418/55.4
6,544,014 B2 * 4/2003 Kobayashi ..... 418/55.4

FOREIGN PATENT DOCUMENTS

JP 06042472 A * 2/1994 ..... 418/55.4
JP 08291796 A * 11/1996
JP 2002371978 A * 12/2002

* cited by examiner

*Primary Examiner* — Theresa Trieu
(74) *Attorney, Agent, or Firm* — Baker Botts L.L.P.

(57) ABSTRACT

In a scroll compressor, a fixed scroll (3) and a movable scroll (5) each having a spiral body are engaged with each other, grooves (13, 14) extending along the spiral shape of the spiral body are formed on the forward end surface of the spiral body of at least either one of the fixed scroll and movable scroll, and tip seals (11, 12) are disposed in the grooves so as to project from the forward end surface and be slidable on the bottom plate surface of the other scroll facing the forward end surface. The tip seals have large projection parts (17, 18) with a larger amount of projection from the forward end surface and small projection parts (19, 20) with a smaller amount of projection from the forward end surface, and the large projection parts and small projection parts are arranged alternately in the direction along the spiral shape of the spiral body. The scroll compressor does not produce an excessive load at the end of the wall of the scroll while achieving the same sealability as in the case of conventional structures, i.e., the efficiency of the compressor can be improved.

5 Claims, 4 Drawing Sheets

SCROLL COMPRESSOR HAVING SPIRAL BODIES WITH SEAL PROJECTIONS

CROSS-REFERENCE TO RELATED APPLICATIONS

This application is the National Stage of International Patent Application No. PCT/JP2007/070147, filed Oct. 16, 2007, which claims the benefit of Japanese Patent Application No. 2006-283698, filed Oct. 18, 2006, the disclosures of which are incorporated herein by reference in their entirety.

TECHNICAL FIELD OF THE INVENTION

The present invention relates to a scroll compressor used in a general air conditioner, an air conditioner for vehicles, etc., and specifically to a structure of a tip seal attached to a forward end of a scroll wall.

BACKGROUND ART OF THE INVENTION

A scroll compressor is known wherein a fixed scroll and a movable scroll each having a spiral body are engaged with each other, and by operating the movable scroll at an orbital movement relative to the fixed scroll, a fluid pocket formed between the spiral bodies of both scrolls is moved toward the center and its capacity is reduced, thereby compressing the fluid (for example, refrigerant) in the fluid pocket. In such a scroll compressor, in order to seal the inside of the fluid pocket, a structure is usually employed wherein a groove extending along the spiral shape of the spiral body of the scroll is formed on the forward end surface of the spiral body, and a tip seal is disposed in the groove so as to project from the forward end surface and be slidable on a bottom plate surface of the other scroll facing the forward end surface.

In this tip seal disposition, a structure is usually employed wherein the tip seal is projected from the forward end surface of the spiral body with a predetermined constant amount of projection. Further, in order to deal with bending of a movable scroll ascribed to press fitting of a drive bearing and increase of a gap between scrolls at a central portion caused by the bending, a structure is also known wherein the amount of projection of the tip seal (height from the forward end surface of the spiral body) is set so as to become higher as located closer to the central portion of the spiral shape (patent document 1). For example, as depicted in FIG. 6, a structure is known wherein spiral body 102 of fixed scroll 101 and spiral body 104 of movable scroll 103 are engaged with each other, and the material thicknesses of tip seals 105, 106 are increased, and as depicted in FIG. 7, a structure is known wherein the material thicknesses of tip seals 107, 108 are set at a same thickness, the depths of grooves for tip seals 109, 110 are set shallower as located closer to the central portion, and the amounts of projection of the tip seals from the forward end surfaces of the spiral bodies are set higher as located closer to the central portion, thereby achieving the sealability of the fluid pocket.

Patent document 1: JP-A-8-291796

DISCLOSURE OF THE INVENTION

Problems to be Solved by the Invention

In the above-described conventional structures, however, because the sealability between the forward end of the wall of the spiral body of one scroll and the bottom plate surface of the other scroll is attached importance to, when the internal temperature or pressure of the compressor is elevated, a great compression force may operate to the central portion of the spiral body (both of the forward end surface side of the spiral body and the bottom plate surface side of the scroll) via the tip seal. Further, there is a fear that the forward end surface of the wall of the spiral body of the scroll and the bottom plate surface of the other scroll may come into metal contact with each other by thermal expansion, and whereby galling or seize of the forward end may occur. Furthermore, by such reasons, the consumption power of the compressor may become great, and the efficiency of the compressor may be reduced.

Accordingly, paying attention to the above-described problems, an object of the present invention is to provide a structure of a tip seal portion of a scroll compressor which does not produce an excessive load at a forward end of a wall of a scroll while ensuring the same sealability as in the conventional structures, namely, which can improve the efficiency of the compressor.

Means for Solving the Problems

To achieve the above-described object, a scroll compressor according to the present invention has a fixed scroll and a movable scroll each having a spiral body which are engaged with each other, a groove extending along a spiral shape of the spiral body formed on a forward end surface of the spiral body of at least one of the fixed scroll and movable scroll, and a tip seal disposed in the groove so as to project from the forward end surface and be slidable on a bottom plate surface of the other scroll facing the forward end surface, and in this scroll compressor, the tip seal comprises large projection parts with a larger amount of projection from the forward end surface and small projection parts with a smaller amount of projection from the forward end surface, and the large projection parts and the small projection parts are arranged alternately in a direction along the spiral shape of the spiral body.

Namely, as initial setting, the large projection parts and the small projection parts of the tip seal are arranged alternately in the direction along the spiral shape of the spiral body, and in the operation condition, when the internal temperature or pressure is elevated, first the large projection parts are pressed onto the bottom plate surface of the other scroll, and succeedingly, the small projection parts adjacent thereto are pressed onto the bottom plate surface of the other scroll. Consequently, in particular, the amount of deformation of the small projection parts due to the above-described pressing is suppressed small, the compression force generated between the forward end surface of the spiral body and the bottom plate surface of the other scroll is suppressed low as a whole, and occurrence of galling or seize of the forward end of the scroll may be prevented. Further, because the large projection parts and the small projection parts of the tip seal arranged alternately are pressed onto the bottom plate surface of the other scroll, the compression force is suppressed low as a whole as described above as well as the contact pressure is maintained at an appropriate pressure by the low compression force, and therefore, the sealability of the fluid pocket may be ensured as the same good sealability as in the conventional structure. Moreover, by the above-described reduction of compression force, the compressor drive torque is also reduced, and it also becomes possible to reduce the consumption power of the compressor, namely, to improve the efficiency of the compressor. Furthermore, by the alternate arrangement of the large projection parts and the small projection parts of the tip seal, the movement and the posture of the movable scroll at the time of orbital movement of the movable scroll may be easily stabilized, thereby contributing to a more smooth operation of the compressor.

In this scroll compressor according to the present invention, it is preferred that the tip seal is provided to each of the fixed scroll and the movable scroll, and the large projection parts of the fixed scroll and the large projection parts of the movable scroll are disposed at positions complementing each other in the direction along the spiral shape of the spiral body, namely, the large projection parts of one scroll are disposed at positions corresponding to the small projection parts of the other scroll, and the large projection parts of the other scroll are disposed at positions corresponding to the small projection parts of the one scroll. By employing such a complementing disposition, more uniform and more desirable sealability may be achieved, and the structure for preventing occurrence of excessive compression force may be provided with a better balance.

Further, it is preferred that the large projection parts are disposed at a predetermined same pitch in angle in a scroll circumferential direction. Also by employing such a formation of disposition at a same pitch in angle, more uniform and more desirable sealability may be achieved, and the structure for preventing occurrence of excessive compression force may be provided with a better balance.

The above-described large projection parts either may be formed by changing a thickness of the tip seal in a scroll axial direction, or may be formed by changing a depth of the groove, and as the case may be, both structures may be combined.

Furthermore, although the amounts of projection of the small projection parts from the forward end surface of the spiral body are smaller than those of the large projection parts, a structure may be employed wherein the small projection parts are formed so that the amounts of projection thereof become larger as located closer to a central portion of the spiral body. Namely, this is a structure to which the structure described in the aforementioned Patent document 1 is applied with respect to the small projection parts in the present invention. By this structure, bending of the movable scroll ascribed to press fitting of a drive bearing and increase of a gap between scrolls at a central portion caused by the bending also may be adequately treated.

EFFECT ACCORDING TO THE INVENTION

Thus, in the scroll compressor according to present invention, the compression force at the forward end of the scroll wall at the time of compressor operation may be decreased, and occurrence of galling or seize of the forward end of the scroll may be prevented.

Further, by decreasing the compression force as described above, the compressor drive torque may also be decreased, and therefore, the consumption power may be reduced, that is, the efficiency of the compressor may be improved. Furthermore, by the alternate disposition of the large projection parts and the small projection parts of the tip seal, the movement of the movable scroll may be stabilized.

EXPLANATION OF SYMBOLS

Figure 1:
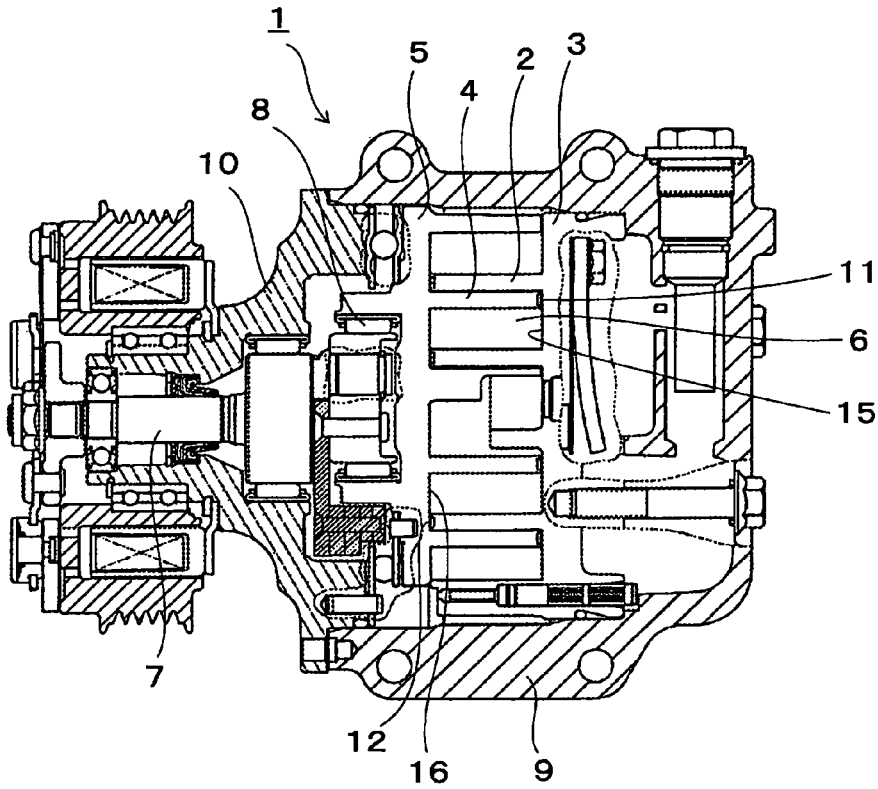
FIG. 1 is a vertical sectional view of a scroll compressor according to an embodiment of the present invention.

1: scroll compressor
2, 4: spiral body
3: fixed scroll
5: movable scroll
6: fluid pocket
7: drive shaft
8: drive bearing
9: body housing
10: front housing
11, 12: tip seal
13, 14: groove
15, 16: bottom plate surface of the other scroll
17, 18: large projection part
19, 20: small projection part

THE BEST MODE FOR CARRYING OUT THE INVENTION

Hereinafter, desirable embodiments of the present invention will be explained referring to figures.

Figure 2:
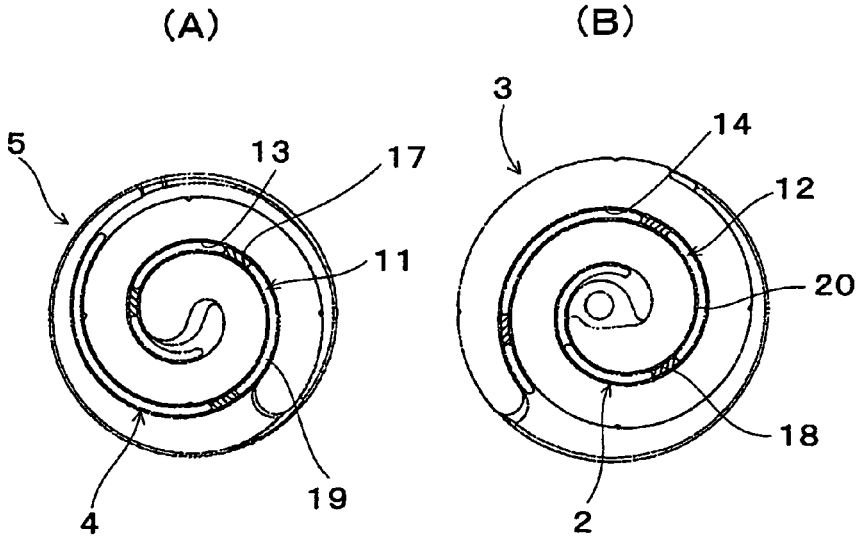
FIG. 2 shows elevational views of respective scrolls of the compressor depicted in FIG. 1, as viewed from the respective spiral body sides.
Figure 3:
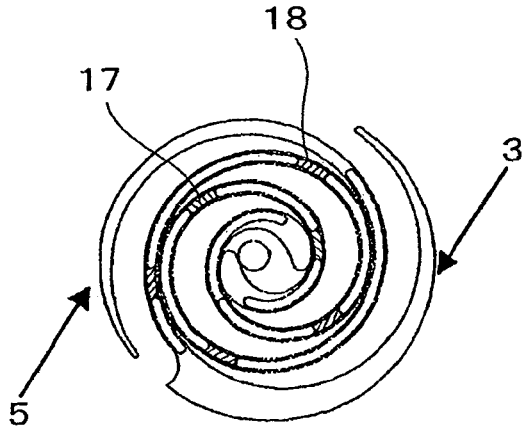
FIG. 3 is a schematic diagram showing a combination condition of the scrolls depicted in FIG. 2.

FIGS. 1 to 3 shows a scroll compressor according to an embodiment of the present invention.

In FIG. 1, symbol 1 indicates the whole of the scroll compressor, and compressor 1 has a fixed scroll 3 with a spiral body 2 and a movable scroll 5 with a spiral body 4, which are engaged with each other. Movable scroll 5 is served to an orbital movement relative to fixed scroll 3 at a condition where its rotation is prevented, and fluid pockets 6 formed between both scrolls are moved toward the central portion to compress fluid. Movable scroll 5 is driven by a drive shaft 7 comprising a crank shaft, and the drive force for the orbital movement is transmitted to movable scroll 5 via a drive bearing 8 which is press fitted at the back surface side of movable scroll 5. Where, in FIG. 1, symbol 9 indicates a body housing, and symbol 10 indicates a front housing, respectively.

As shown also in FIG. 2, tip seals 11, 12 each extending along the spiral shape of the spiral body are provided on the respective forward end surfaces of spiral body 4 of movable scroll 5 and spiral body 2 of fixed scroll 3. Respective tip seals 11, 12 are disposed in respective grooves 13, 14 formed on the forward end surfaces of spiral bodies 4, 2 so as to project from the forward end surfaces of spiral bodies 4, 2, and the tip surfaces of the projected portions are slidable onto bottom plate surfaces 15, 16 (FIG. 1) of the other scrolls 3, 5. In these tip seals 11, 12, formed are large projection parts 17, 18 whose amounts of projection from the forward end surfaces of spiral bodies 4, 2 are relatively larger and small projection parts 19, 20 whose amounts of projection from the forward end surfaces are relatively smaller, and the large projection parts 17 and small projection parts 19 and the large projection parts 18 and small projection parts 20 are disposed alternately in the directions along the respective spiral shapes of spiral bodies 4, 2.

Figure 5:
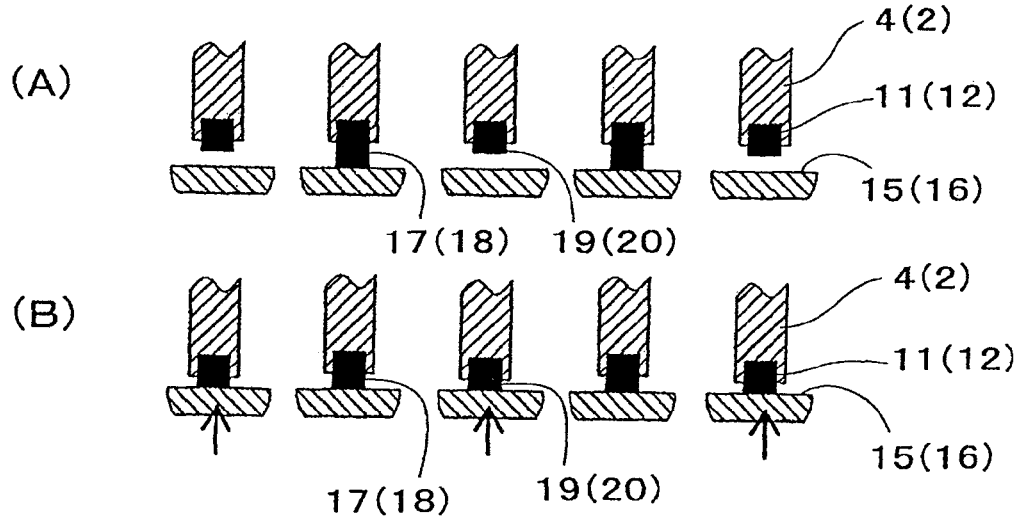
FIG. 5 shows schematic sectional views of a tip seal portion at an initial condition and a condition during operation in the compressor depicted in FIG. 1.
Figure 6:
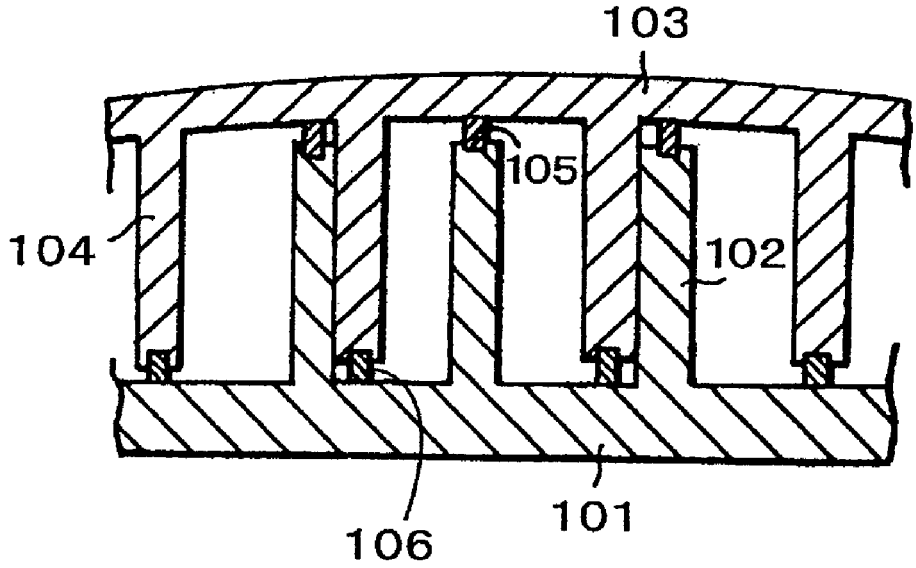
FIG. 6 PRIOR ART
FIG. 6 is a schematic sectional view of a tip seal portion of a conventional compressor.
Figure 7:
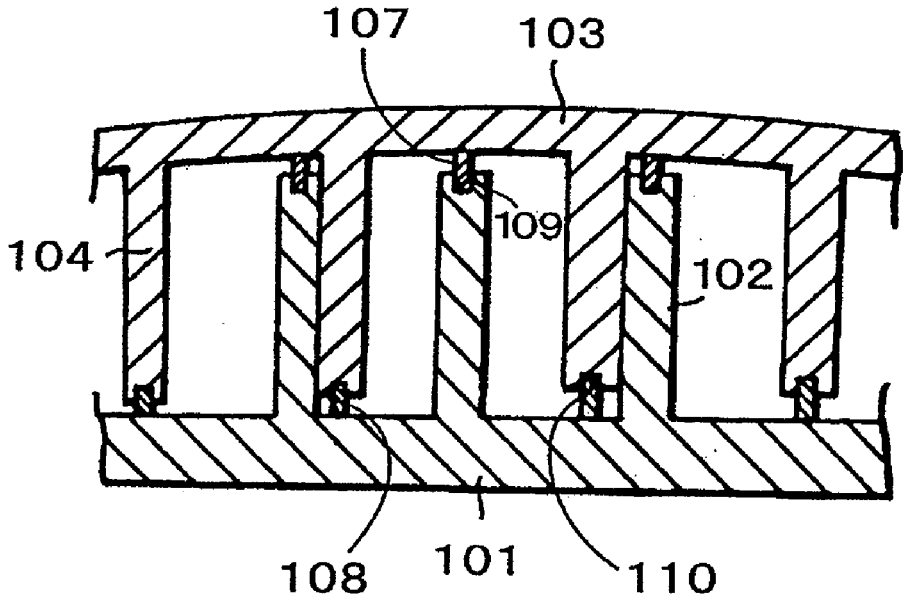
FIG. 7 PRIOR ART
FIG. 7 is a schematic sectional view of a tip seal portion of another conventional compressor.
Figure 8:
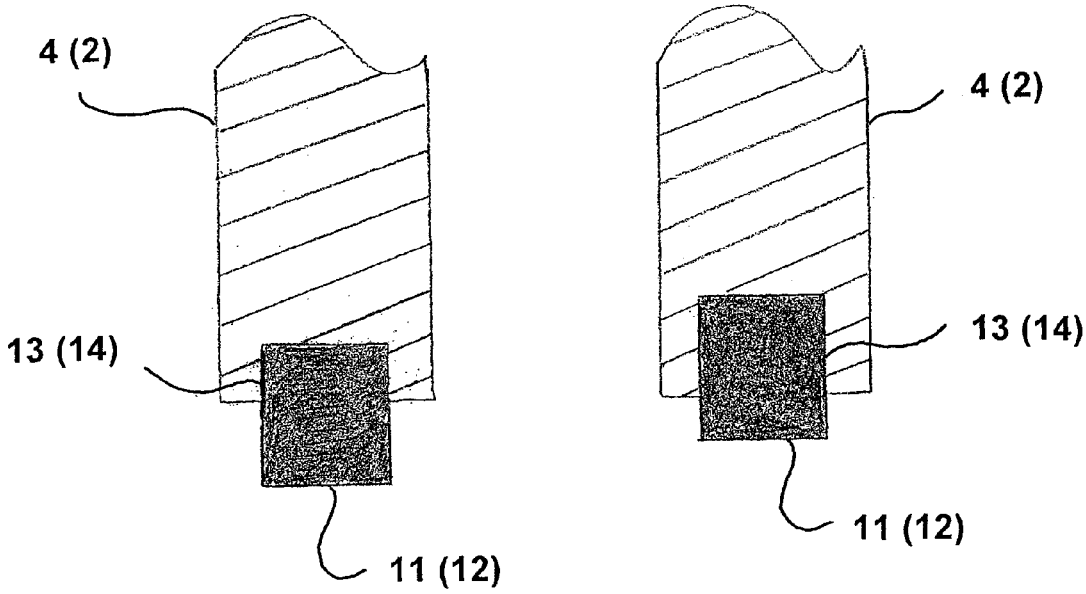
FIG. 8 shows schematic sectional views of the tip seal portion wherein the large projection parts are formed by changing a depth of the groove.

The above-described large projection parts 17, 18 can be formed by changing the thicknesses of respective tip seals 11, 12 in the scroll axial direction (depicted in FIG. 5). Further, as depicted in FIG. 8, they may be formed by setting the thicknesses of the respective tip seals to be substantially uniform, and changing the depths of the above-described grooves 13, 14. These both structures may be combined. Moreover, although the amounts of projection of the above-described small projection parts 19, 20 from the forward end surfaces of the spiral bodies are smaller than those of large projection parts 17, 18, a structure may also be employed together wherein the small projection parts are formed so that the amounts of projection thereof become larger as located closer to the central portions of the spiral bodies, that is, the structure disclosed in the aforementioned Patent document 1.

Then, in this embodiment, the above-described large projection parts 17, 18 are disposed at a predetermined same pitch in angle (about 120 degree pitch) in the scroll circumferential direction. Further, as depicted in FIG. 3, in the condition combined with fixed scroll 3 and movable scroll 5, large projection parts 18 of fixed scroll 3 and large projection parts 17 of movable scroll 5 are disposed at positions complementing each other in the direction along the spiral shape of the spiral body, namely, the large projection parts of one scroll are disposed at positions corresponding to the small projection parts of the other scroll, and the large projection parts of the other scroll are disposed at positions corresponding to the small projection parts of the one scroll.

Figure 4:
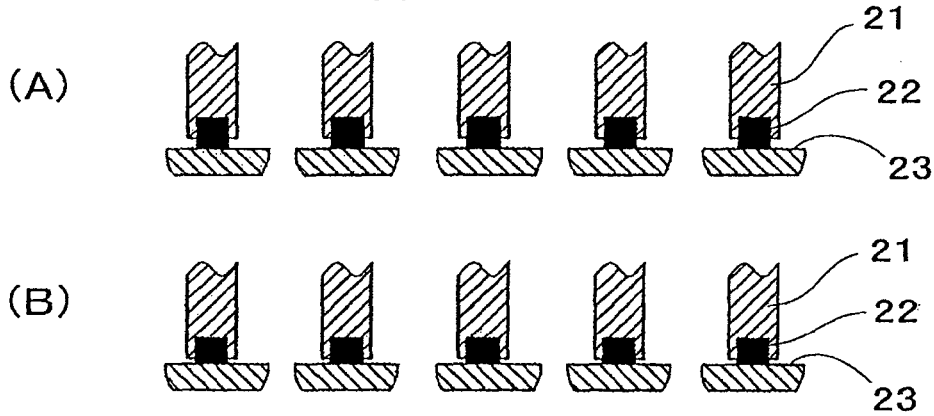
FIG. 4 PRIOR ART
FIG. 4 shows schematic sectional views of a tip seal portion at an initial condition and a condition during operation in a conventional structure, shown for comparison.

The operation and advantage in such a tip seal structure according to this embodiment thus constructed will be explained comparing with a conventional structure, referring to FIG. 4 (conventional structure) and FIG. 5 (structure according to this embodiment). In the conventional structure where the amount of projection of tip seal 22 from the forward end surface of spiral body 21 as depicted in FIG. 4(A), when the initial condition (A) is transferred to the operation condition depicted in FIG. 4(B) and the inside temperature or the inside pressure is elevated, as aforementioned, the projected tip seal 22 is pressed onto bottom plate surface 23 of the other scroll, and an excessive compression force may operate.

In this embodiment, however, as depicted in FIG. 5(A), at the initial condition, large projection parts 17 (18) and small projection parts 19 (20) of tip seal 11 (12) are disposed alternately in the direction along the spiral shape of spiral body 4 (2), and when the condition is transferred to the operation condition depicted in FIG. 5(B) and the inside temperature or the inside pressure is elevated, first large projection parts 17 (18) are pressed onto bottom plate surface 15 (16) of the other scroll, and succeedingly, adjacent small projection parts 19 (20) are pressed onto bottom plate surface 15 (16) of the other scroll. At that time, the amounts of deformation of small projection parts 19 (20) due to the above-described pressing are suppressed small, the compression force produced between the forward end surface of spiral body 4 (2) and bottom plate surface 15 (16) of the other scroll is suppressed low as a whole, and therefore, occurrence of galling or seize of the forward end of the scroll may be prevented. Further, because large projection parts 17 (18) and small projection parts 19 (20) of tip seal 11 (12) disposed alternately are pressed onto bottom plate surface 15 (16) of the other scroll, while the compression force is suppressed low as a whole as described above, the contact pressure may be maintained as an appropriate pressure as a whole, and therefore, the sealability of the fluid pocket may be ensured as a good sealability similarly in the conventional structure. Moreover, by the above-described reduction of compression force, the drive torque of compressor 1 may also be decreased, the consumption power of compressor 1 may be decreased, namely, the efficiency of compressor 1 may also be improved. Furthermore, as an advantage derived from the alternate disposition of large projection parts 17 (18) and small projection parts 19 (20) of tip seal 11 (12), the movement and posture of movable scroll 5 at the time of the orbital movement of movable scroll 5 may be easily stabilized, and it may contribute to a smoother operation of compressor 1.

Further, as in this embodiment, by the disposition of large projection parts 17, 18 at positions complementing each other, movement and operation good in balance may become possible.

Industrial Applications of the Invention

The structure of the scroll compressor according to the present invention can be applied to any type scroll compressor used in any field which has a tip seal.

The invention claimed is:

1. A scroll compressor having a fixed scroll and a movable scroll each having a spiral body which are engaged with each other, a groove extending along a spiral shape of said spiral body formed on a forward end surface of said spiral body of at least one of said fixed scroll and movable scroll, and a tip seal disposed in said groove so as to project from said forward end surface and be slidable on a bottom plate surface of the other scroll facing said forward end surface, said tip seal comprising large projection parts with a larger amount of projection from said forward end surface and small projection parts with a smaller amount of projection from said forward end surface, said large projection parts and said small projection parts being arranged alternately in a direction along said spiral shape of said spiral body, wherein said small projection parts are formed, so that amounts of projection of said small projection parts from said forward end surface become larger as located closer to a central portion of said spiral body.

2. The scroll compressor according to claim 1, wherein said tip seal is provided to each of said fixed scroll and said movable scroll, and said large projection parts of said fixed scroll and said large projection parts of said movable scroll are disposed at positions complementing each other in said direction along said spiral shape of said spiral body.

3. The scroll compressor according to claim 1, wherein said large projection parts are disposed at a predetermined same pitch in angle in a scroll circumferential direction.

4. The scroll compressor according to claim 1, wherein said large projection parts are formed by changing a thickness of said tip seal in a scroll axial direction.

5. The scroll compressor according to claim 1, wherein said large projection parts are formed by changing a depth of said groove.

* * * * *